United States Patent [19]

Bräuning

[11] Patent Number: 4,703,974

[45] Date of Patent: Nov. 3, 1987

[54] SEAT FURNITURE

[75] Inventor: Egon Bräuning, Weil am Rhein, Fed. Rep. of Germany

[73] Assignee: Protoned B.V., Amsterdam, Netherlands

[21] Appl. No.: 786,214

[22] Filed: Oct. 10, 1985

[30] Foreign Application Priority Data

Oct. 23, 1984 [CH] Switzerland ..... 5064/84

[51] Int. Cl.[4] ..... A47C 3/00

[52] U.S. Cl. ..... 297/285; 297/300; 297/421; 297/323; 248/188.7

[58] Field of Search ..... 297/285, 300, 316, 320, 297/323, 421; 248/188.7

[56] References Cited

U.S. PATENT DOCUMENTS

| | | | |
|---|---|---|---|
| 4,084,850 | 4/1978 | Ambasz | 297/300 |
| 4,131,315 | 12/1978 | Vogtherr | 297/421 |
| 4,157,203 | 6/1979 | Ambasz | 297/285 |
| 4,200,332 | 4/1980 | Brauning | 297/300 |
| 4,270,797 | 6/1981 | Brauning | 297/300 |
| 4,318,570 | 3/1982 | Adam et al. | 248/188.7 |
| 4,333,683 | 6/1982 | Ambasz | 297/300 |
| 4,408,800 | 10/1983 | Knapp | 297/285 |
| 4,451,085 | 5/1984 | Franck et al. | 297/285 |
| 4,562,986 | 1/1986 | Frascaroli et al. | 248/188.7 |

*Primary Examiner*—Francis K. Zugel

*Attorney, Agent, or Firm*—Ladas & Parry

[57] ABSTRACT

The seat furniture is provided with a seat-plate backrest inclination-adjusting mechanism (6), a single-column supporting device (2) and a supporting foot (1). The backrest is composed of a backrest bottom part (16) and a backrest top part (14), and when the backrest inclination is fixed the backrest top part (14) can additionally be moved, counter to the pressure exerted by a restoring-spring arrangement (13), so as to swing freely to the rear between a first and a second stop position of an adjusting-spring device (22).

15 Claims, 16 Drawing Figures

Figure 1A:
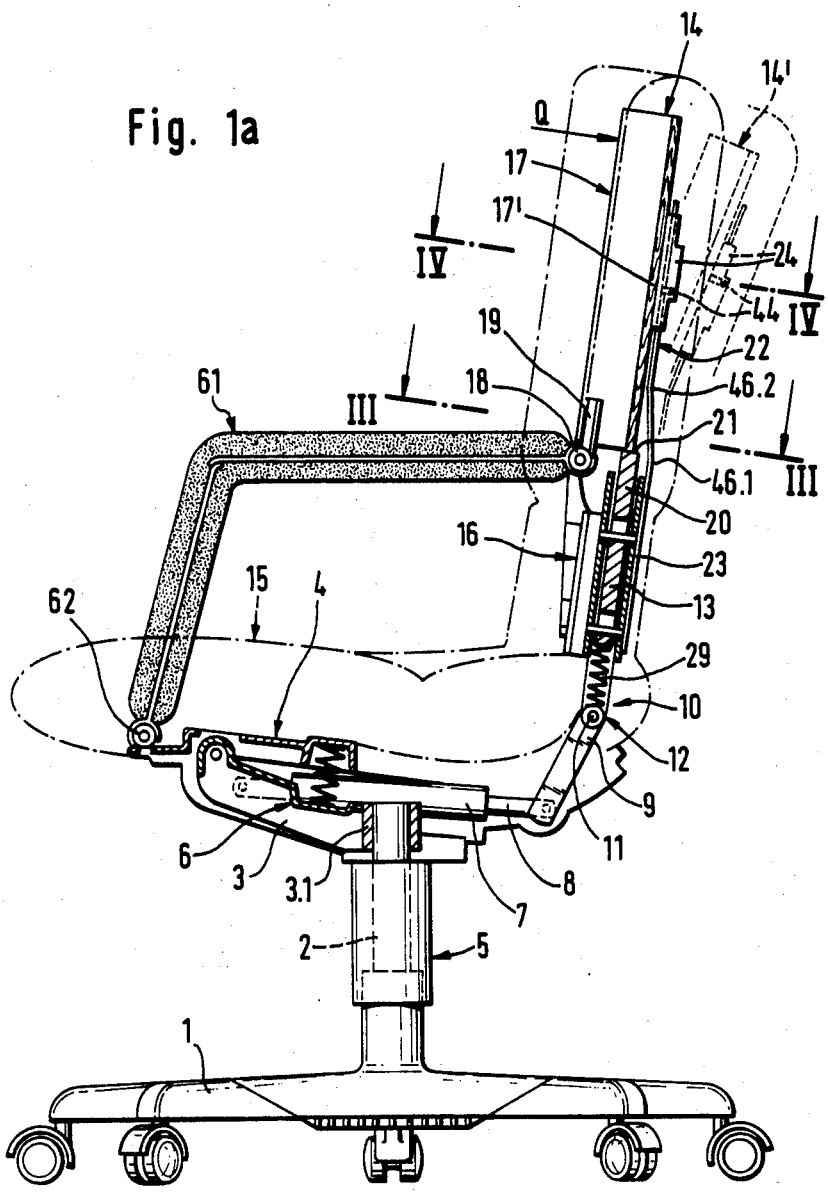

45.1
44
43
42
45.2
23
17'

24
23
a
a
44
42
17'
37,38,39

17
33
12
16
9'
23
13
25
34
16
12
33
35
17
39
36
18
37
40
38

41
64
69
61
68
66
67
65
63
a1
a2
70
71
72
69.1,69.2
64,65
69.2
74.1
74.2
73.1
73.2
75

85
88
83
84
90
89
91
83''
83'
93
92
94
81
82
86
2
87
a

SEAT FURNITURE

The invention relates to a seat furniture having an adjustable seat and backrest.

Such seat furniture for high-class comfort generally has a seat-plate/backrest adjusting mechanism. A characteristic of this is that the backrest inclination adjustment is in a fixed relationship with the seat-plate inclination adjustment. Such a seat furniture emerges from Swiss Pat. No. 629,945 which describes a work chair with a continuous variation of the seat-plate and backrest inclination adjustment in the same direction. The associated adjusting mechanism contains, in addition to a pneumatic spring, a hellical compression spring connected in parallel with this, the pneumatic spring performing not only its function as a spring element, but also the function of an adjusting member. The aim of the parallel connection of the spring elements is to increase the deflection of the brackrest to the rear counter to a progressively increasing spring force, the resultant adjusting movement being caused as a result of the rearward movement of the upper part of the chair user's body. When the backrest is relieved of pressure, it, together with the seat plate, returns to a position of less rearward inclination or finally, to an approximately vertical initial position of the backrest. When the pneumatic spring is free-running, the cycle of movement can be repeated as desired. When the pneumatic spring is switched over to be used as an adjusting member, the cycle of movement can be stopped in any backrest inclination position and the backrest position consequently fixed.

Thus, it is possible, actually, to prevent a continuous pendulum movement of the seat-plate/back rest combination or of the adjusting mechanism, which can be undesirable particularly when the user's weight is shifted only slightly. Nevertheless, the seat furniture at the same time loses an essential component of comfort, namely the automatic adjustment of the backrest inclination when the user would like to lean back for a short time, unless the adjusting mechanism is released. There is a need for such a mobility of the backrest, particularly when the seat furniture is supposed to permit the possibility of adapting it to different forms of use quickly and without actuation of the adjusting means.

The object to be achieved, by the invention is, therefore, a further development of the adjusting mechanism of such seat furniture improving the functioning of the backrest in such a way that the section of a backrest for supporting the shoulder and the middle region of the spinal column of a user remains pivotable to the rear as a function of pressure exerted on it, even when the adjusting mechanism for a seat plate and the rest of the backrest is locked, irrespective of their locked position.

Building on a basic construction allowing the additional pivoting of the backrest, a further object is to provide a control and supporting device for a headrest on the seat furniture, this headrest being arranged pivotably above the said backrest section.

A third object to be achieved according to the invention relates to the design of an armrest, in which the ends of an arm resting and supporting section are mounted on link pins which are attached at points on the seat-furniture structure which are pivotable relative to one another.

Another object to be achieved according to the invention relates to the design of a single-column supporting foot for the seat furniture, which can be provided with exchangeable supporting elements.

Figure 1B:
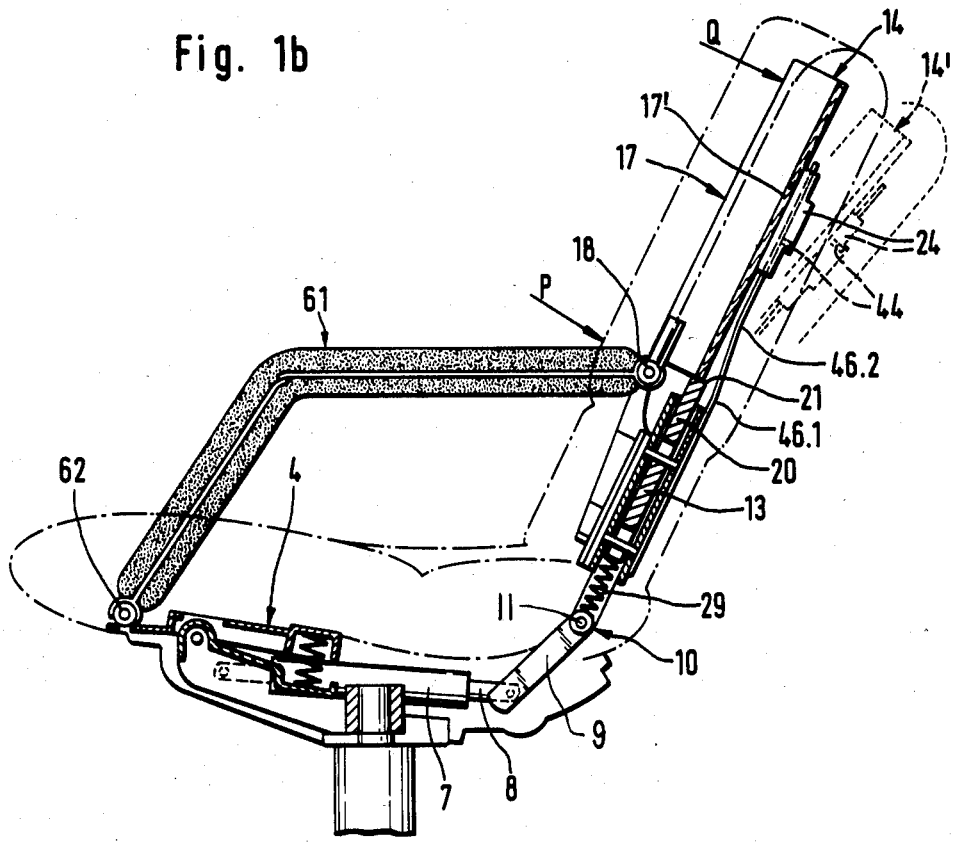
Figure 2B:
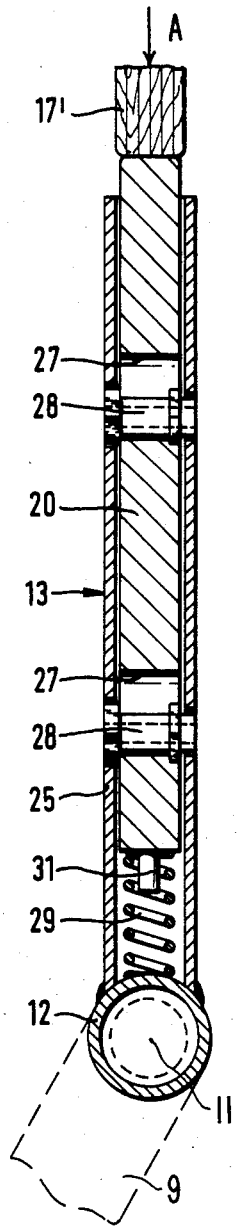
Figure 2A:
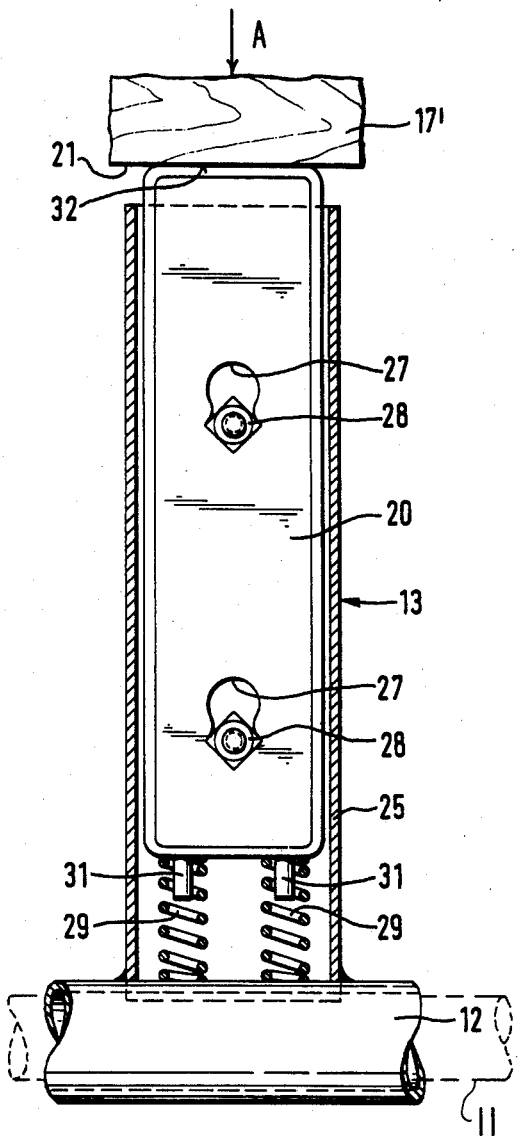
Figures 3, 4, 4A:
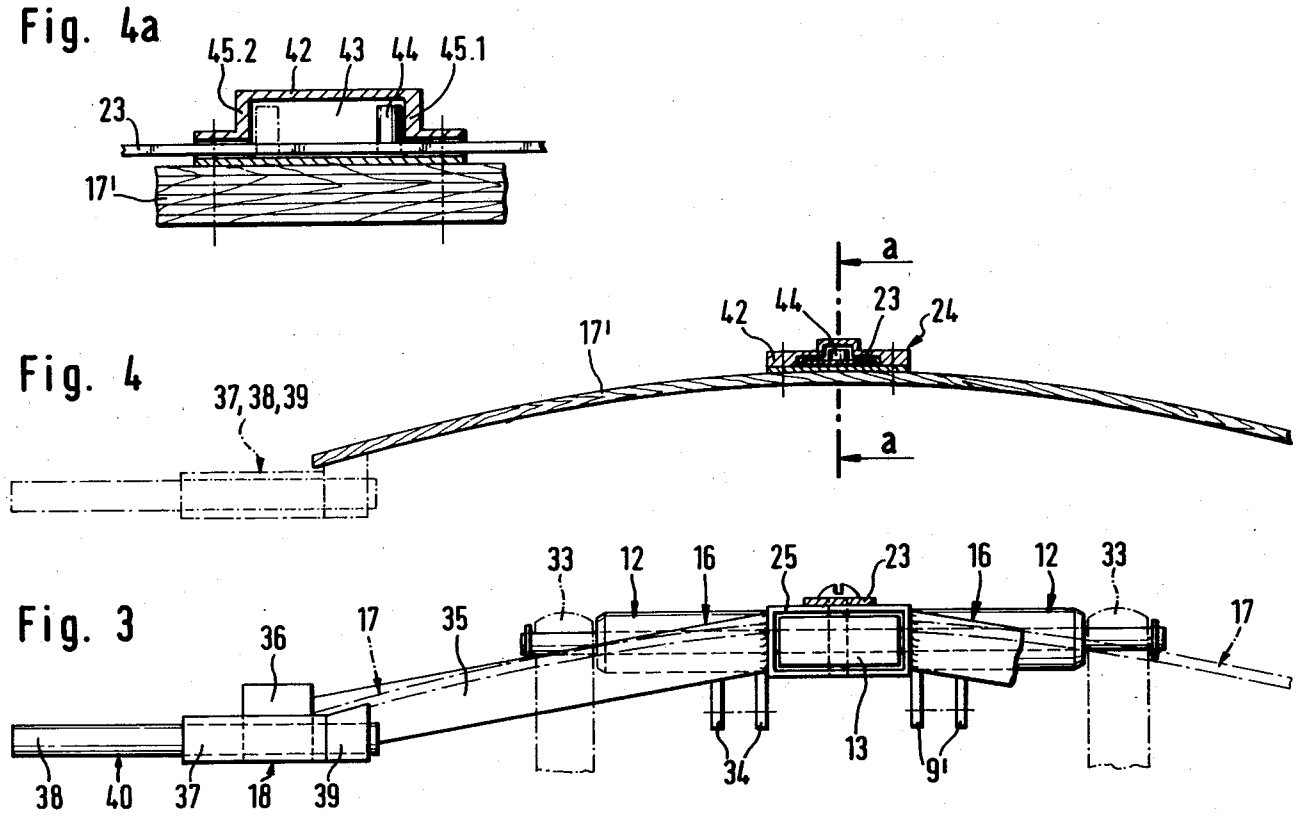
Figure 5A:
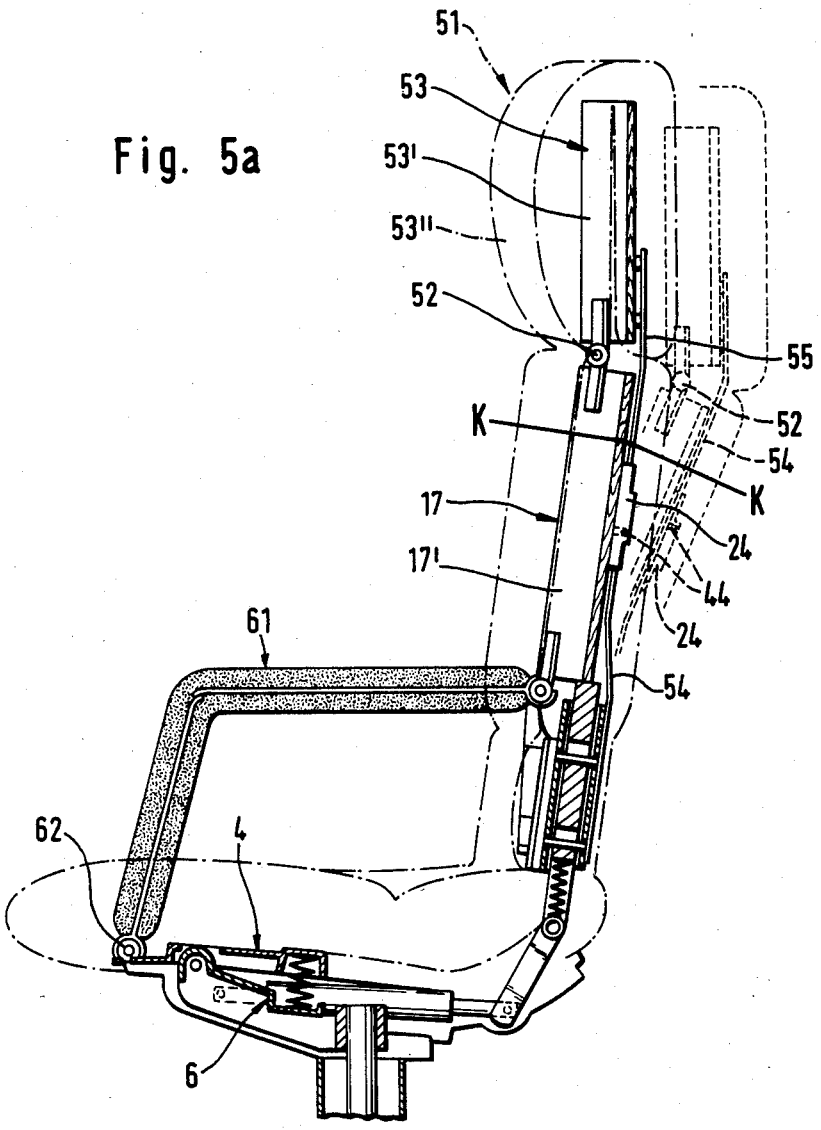
Figure 5B:
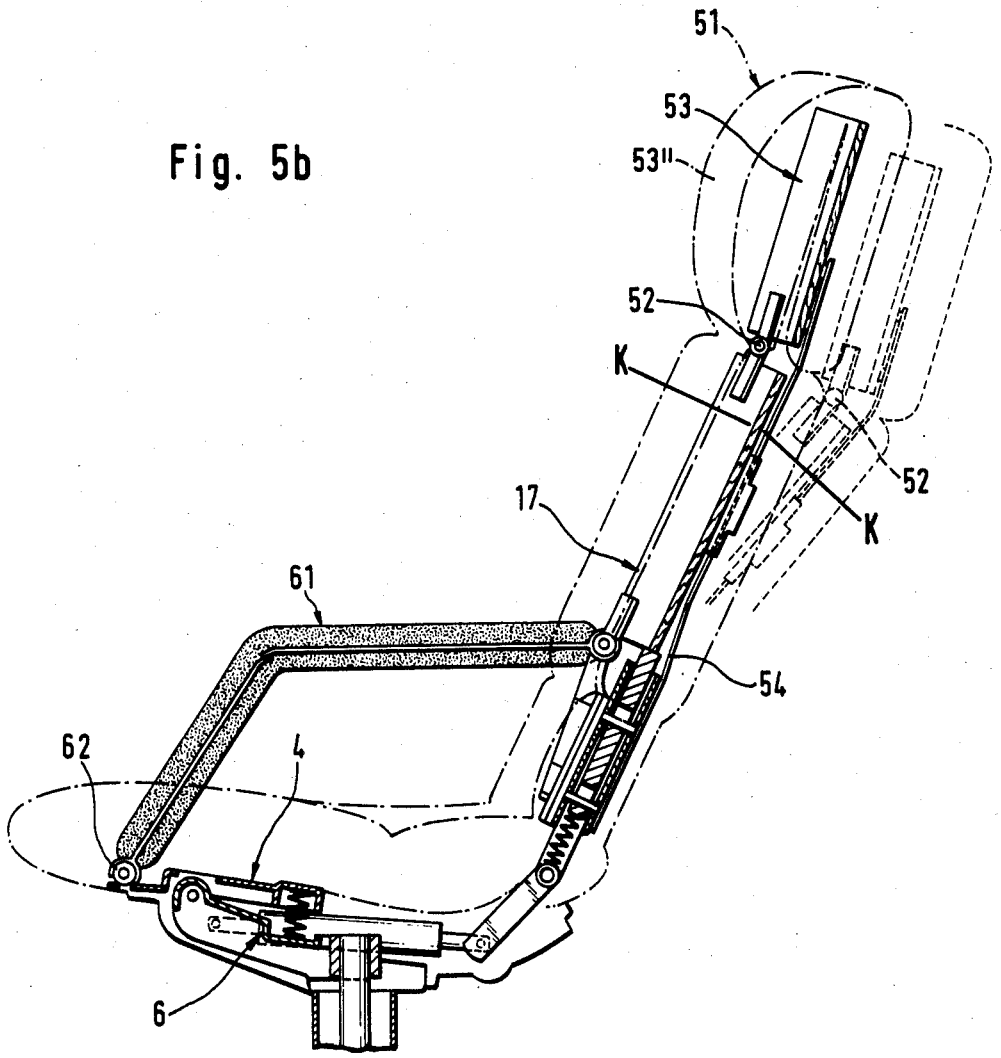
Figures 6, 6A, 6B, 6C:
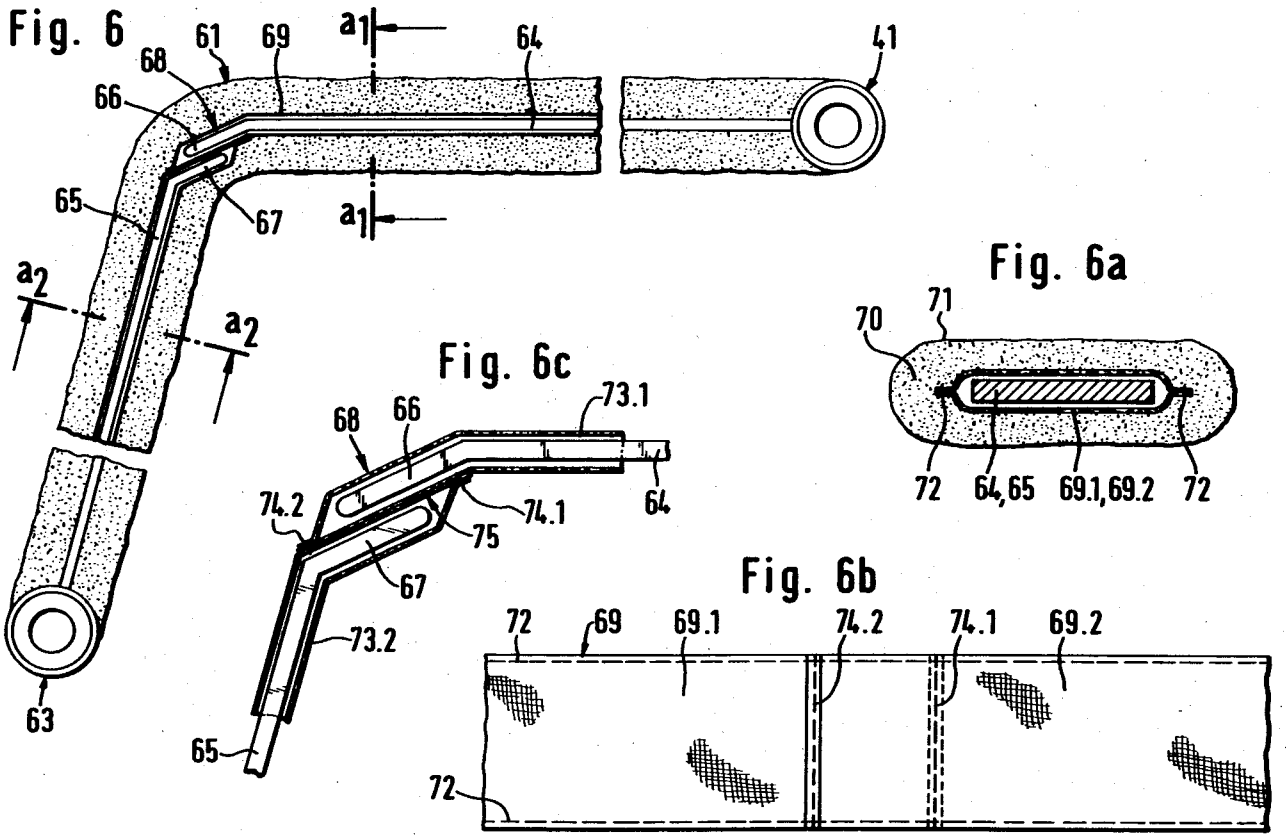
Figures 7, 7A, 7B:
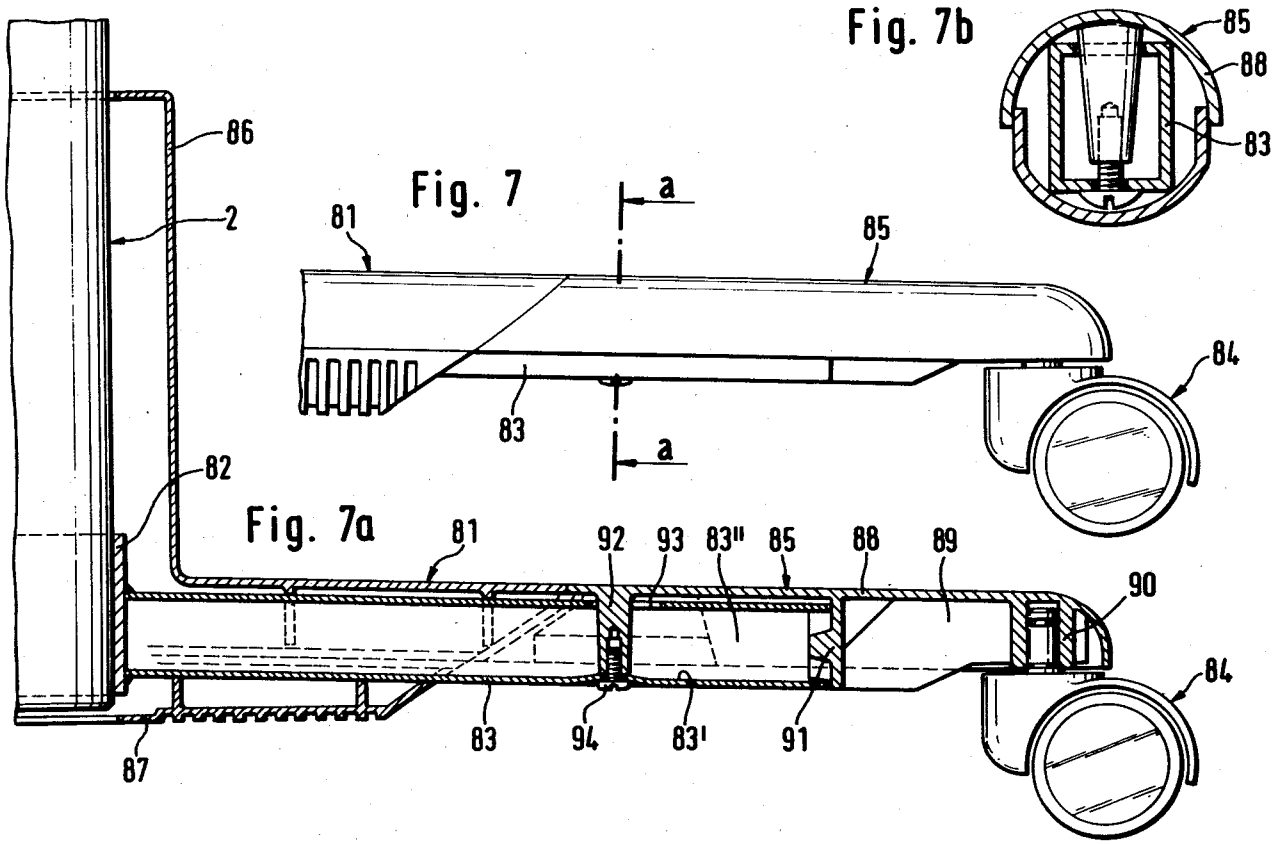

The invention is explained below by way of example with reference to the drawing. In the drawing:

FIGS. 1*a* and 1*b* show the seat furniture according to the invention in a first embodiment, partially in section in the vertical center plane, in two extreme positions of the seat plate and backrest, FIGS. 2*a* and 2*b* show the spring unit of the backrest pendulum device on a larger scale, in two sectional representations arranged 90° relative to one another, FIG. 3 shows a simplified section along the line III—III in FIG. 1*a*, FIGS. 4 and 4*a* show a horizontal section along the line IV—IV in FIG. 1*a* and a vertical section along the line a—a in FIG. 4, FIGS. 5*a* and 5*b* show the seat furniture according to the invention in a second embodiment provided with a headrest, in the same manner of representation as in FIGS. 1*a* and 1*b*, FIGS. 6 and 6*a* to 6*c* show the armrest on the seat furniture according to FIGS. 1*a* and 5*a* in a longitudinal section and in a cross-sectional representation (FIG. 6*a*), and detailed representations of the armrestcore guide pocket in a horizontal projection (FIG. 6*b*) and the joint region (FIG. 6*c*), and FIGS. 7, 7*a* and 7*b* show the supporting foot of the seat furniture according to FIGS. 1*a* and 5*a* in a partial representation of a supporting arm, in a side view (FIG. 7), a vertical longitudinal section (FIG. 7*a*) and a cross-section (FIG. 7*b*).

Parts performing similar or identical functions in the various Figures are denoted by the same reference numerals.

The seat furniture illustrated in FIGS. 1*a* and 1*b* is mounted on a single-column supporting foot 1 which supports a seat-supporting frame at 4 thereof via a vertically adjustable supporting column 2, for example a pneumatic spring, and seat cap 3.1 of a supporting bracket 3 for the seat-supporting frame. The supporting column 2 is appropriately surrounded by a casing 5 composed, for example, of two tubular members engaging telescopically into one another. Attention is drawn to FIGS. 7, 7*a* and 7*b* for details of a preferred exemplary embodiment of the supporting foot.

The seat-supporting frame 4 contains components of a device which is also referred to below as a synchronous adjusting mechanism 6 and of which FIG. 1*a*, among others, shows a controllable pneumatic spring 7 with a piston rod 8 which is in the extended position. Articulated on the distal end of the said piston rod 8 is the lever arm 9 of a backrest connecting construction 10 which is mounted pivotably about a shaft 11. The shaft 11 is also mounted in a synchronous adjusting mechanism by means of the synchronous adjusting mechanism 6, of which an embodiment is described in Swiss Patent Specification No. 636,252, the elements of the seat plate which are mounted on the seat-supporting frame 4 and the elements of the backrest in particular, a backrest top part 14 and a supporting arrangement 16 forming the backrest bottom part, are arranged so as to be pivotable in the same direction and in dependence on one another. The lever arm 9 is connected fixedly to a supporting tube 12. See in this respect FIG. 2*b*.

A lever (not shown) also present on the seatsupporting frame 4 makes it possible to actuate an overflow valve in the pneumatic spring, which in the open position allows the displacement of the piston rod 8 of the pneumatic spring 7, but in the closed position blocks i.e. locks the piston rod. When the piston rod 8 is pushed inwards into the pneumatic-spring cylinder (see FIG. 1*b*), the backrest connecting construction 10 is pivoted by the lever arm 9 in the clockwise direction about the shaft and the backrest parts 14, 16 is consequently transferred into the position according to FIG. 1*b*. However, this pivoting movement occurs only when, with the overflow valve of the pneumatic spring 7 open, a pivoting force P is exerted at the same time, preferably because the seat user leans back.

Referring back to FIG. 1*a*, the result of the extension of the piston rod 8 of the pneumatic spring is that via the lever arm 9 a spring-loaded slide unit 13, together with the connected supporting arrangement 16 of the structure 17 of the backrest top part, is forced into an approximately vertical position. The latter contains a component 17' which is rounded in the form of a shell and which is articulated pivotably on the bearing point 18 via a pair of hinges 19 at the side ends of the supporting arrangement 16. The component 17' is appropriately a plywood shell, which is designed as a carrier of the backrest upholstery, and the lower edge of which is supported on the slide member 20 at 21. An adjusting-spring device 22 ensures primarily that the backrest structure 17 is always held snuggly against the slide member 20. The adjusting-spring device 22 consists essentially of an elongate leaf spring 23 screwed at the bottom to the slide unit 13 and extending up into the backrest structure 17, and of a guide pocket 24 which is fastened to the latter and the details of which emerge from FIGS. 4 and 4*a* and are described later.

For the moment, however, the design of the slide unit 13 will be explained with reference to FIGS. 2*a* and 2*b*. FIG. 3 shows how it is fitted into the supporting arrangement 16.

FIGS. 2*a* and 2*b* show the slide unit 13 on a larger scale and in two sections arranged at 90° relative to one another. Welded on the supporting tube 12 of the synchronous adjusting mechanism 6 is a vertical rectangular tbue 25, in which the slide member 20 is mounted so as to be longitudinally movable over a distance of approximately 1.5 to 2 cm. The movement distance is determined by slots 27, through which pass tubular bolts 28 mounted in the rectangular tube 25. The slide member 20 is subjected to the pressure of strong hellical springs 29 which are inserted with prestress between its underside provided with spring guides 31 and the supporting tube 12. As already mentioned, the upper end 32 of the slide member 20 is in pressing contact with the lower end of the component 17' of the backrest structure 17.

The position of the slide unit 13 within the supporting arrangement 16 emerges from FIG. 3. In this Figure, 12 denotes the supporting tube which is mounted in fork carriers 33 of the said synchronous adjusting mechanism 6. 9' denotes plates corresponding to the lever arm 9 of FIG. 1*a* and 2*b* and 34 designates a pair of plates connected in parallel with the plates 9' and belonging to the synchronous adjusting mechanism 6 according to Swiss Pat. No. 636,252. The supporting arrangement 16 welded to the rectangular tube 25 on each side contains a vertically oriented frame construction 35 which is not shown in detail and which consists of individual horizontal bearers which are each connected at their outer ends to a vertical frame member 36. Located on the latter in a sleeve 37 is an axle journal 38 which carries on its end projecting inwards a hinge element 39 for the articulation of the backrest structure 17 indicated by a dot-and-dash line. The end 40 of the axle journal 38 projecting outwards is intended for receiving the upper joint bush 41 on the armrest (FIG. 6). FIG. 3 also shows the fastening of the elongate leaf spring 23 to the rectangular tube 25 of the slide unit 13.

FIG. 4 illustrates the backrest structure 17 in a sectional on the line IV—IV in FIG. 1*a*. As already mentioned, the component 17' formed, for example, as a plywood shell is held at the bottom and on the outside respectively in a pivot mounting 37/38/39 represented by broken lines and described in detail in FIG. 3. The guide pocket designated as a whole by 24 and intended for the leaf spring 23 is fastened essentially centrally to the backrest component 17'. According to FIG. 4*a*, it consists of a vertically oriented stop housing 42 with an elongate cavity 43, in which a relative movement can take place between a projection 44 attached or formed on the likewise vertically oriented leafspring 23 and a lower end stop 45.1 and an upper end stop 45.2. When the projection is positioned at the lower end stop 45.1, the backrest position is fixed in approximately axial alignment with the slide unit 13, whilst the position of the projection at the upper end stop 45.2 corresponds to an approximately 15° to 20° deflection in a clockwise direction of the backrest top part 14' into the position shown by broken lines.

It is therefore now possible already to explain how the seat furniture described operates. It is assumed, in this regard, that the abovementioned synchronous adjustment of the relative inclinations of the seat plate 15 and backrest 14, 16 is known and therefore does not need to be described any further. In other words, the execution of the different seat-plate and backrest inclinations on the seat furnitures shown by unbroken lines in FIGS. 1*a* and 1*b* is assumed to be known. It is therefore clear that in any of these inclined positions the axial alignment between the slide unit 13 and the backrest structure 17 remains the same, unless a pressure force Q is exerted on the backrest top part 14 above the bearing point 18. Such a force Q occurs when, with the pneumatic spring locked, that is to say with a fixed inclined position, or with full inclination adjustment and a free-running pneumatic-spring piston rod 8 (in addition), the user of the seat furniture would like to move further backwards to assume a more relaxed body position. When the force Q is exerted, the lower end of the backrest-structure component 17' pivotable to the rear about the bearing point 18 acts at the point 21 to an increased extent on the sprung slide member 20 (see the arrow A in FIGS. 2*a* and 2*b*) of the slide unit 13. When a pressure force Q at which the prestress of the hellical springs 29 is overcome is reached, the backrest 14 starts to pivot in the clockwise direction. At the same time, the slide member 20 is forced downwards, counter to the progressively increasing prestress of the springs 29, into a position of equilibrium corresponding to the amount of pressure force Q, that it to say the additional inclination of the backrest is dependent on the pressure force Q and is cancelled again when the latter becomes zero.

As already mentioned in the description of FIGS. 2*a* and 2*b* the movement distance of the slide member 20 is limited by the length of the slots 27. However, if the possible slide distance were fully utilized, this would result in a hard impact of the backrest top part 14 after full deflection. This is prevented in the following way by the adjusting-spring device 22: the leaf spring 23 FIGS. 1*a* and 1*b*, has above the slide unit 13 two bends 46.1 and 46.2, by means of which the leafspring 23 experiences longitudinal shaping in the form of an S, as result of which not only a pivoting prestress acting in the anticlockwise direction but also a longitudinal elasticity is imparted to the leaf spring 23. The result of the said longitudinal elasticity is that a gentle braking effect is obtained when the projection 44 comes up against the upper end stop 45.2 (FIG. 4*a*). The said pivoting prestress ensures that, with an increasing longitudinal thrust, the leaf spring 23 does not bend outwards, but inwards towards the component 17'.

Because the prestress of the hellical springs 29 and the length of the slots 27 in the slide unit 13, the amount of longitudinal elasticity of the leaf spring 23 and its pivoting prestress by means of the bends 46.1 and 46.2 as well as the free movement travel of the projection 44 in the guide pocket 24 are coordinated with one another as effectively as possible, it is possible to obtain a value for the defecting pressure force Q and ensure that the deflecting movement of the backrest top part 14 into its position 14' is braked in a substantially impact-free manner.

According to FIGS. 5*a* and 5*b*, the seat furniture constructed on the principle described above can be provided by relatively simple means with a headrest 51 which takes account of ergonomic criteria. It is thus possible to provide in a simple way a seat furniture which meets the highest requirements as regards comfort and in which identical or suitably adapted components of the construction described are used. The following explanations are therfore based in principle on the construction according to FIGS. 1*a* and 1*b*, and components already described there are mentioned or discussed again below only if they have to meet different requirements.

In FIGS. 5*a* and 5*b*, the parts of the seat furniture from the bottom up to the height of lines K—K are the same as those described above. A headrest structure 53 carrying the headrest upholstery 53'' is attached to the upper end of the backrest structure 17 via a hinge 52 present on both sides. The headrest structure 53 can contain a plywood shell part 53' curved in principle according to the component 17'. The leaf spring denoted by 23 in FIGS. 1*a* and 1*b* is extended beyond the guide pocket 24 to approximately one third of the height of the headrest structure 53 and is designated below by 54. Up to the height of the line K—K, its design also corresponds to that of the leaf spring 23. At the height of the hinges 52, it is provided with a forward bend 55 which, on the one hand, is sufficiently rigid to fix by means of the leaf spring alone the basic position of the headrest structure which is otherwise supported only by the hinges 52. Furthermore, at its upper end the leaf spring 54 is connected fixedly to the headrest structure 53.

When the backrest structure 17 is pivoted back into the position shown by broken lines, the leaf spring 54 also travels relatively upwards on the backrest structure upwards in a similar way to the shift of the projection 44 in the guide pocket 24. Since the hinges 52 allow an increase in the distance only in the rest center of the curved shell part 17' and 53', the leaf spring 54 must be aligned exactly relative to this zone. When the leaf spring 54 connected fixedly to the headrest structure 53 is pushed upwards, the headrest structure 53 pivots, with the forward bend 55 being reduced, into an articulation position in which it is approximately parallel to the basic position and at a distance from it. The inclination of the headrest 51 extending in the anti-clockwise direction, in a position of the headrest 51 shown by broken lines, depends not only on the travel of the leaf spring 54, but essentially on the horizontal distance of the connecting line between the hinges 52 and leaf spring 54. In other words, the adjustment of the headrest inclination can be preselected by shifting the center of rotation on the hinges 52 forwards or backwards.

Both the seat furniture according to FIGS. 1*a* and 1*b* and that according to FIGS. 5*a* and 5*b* can be provided with armrests 61 on both sides. These armrests are articulated pivotably, on the one hand, at the front end of the seat frame 4 on the synchronous adjusting mechanism 6 at 62 and, on the other hand, at the bearing point 18 of the backrest structure 17. According to the mutual adjustability of the two bearing points 18 and 62, which emerges from the description of FIGS. 1*a* and 1*b*, the armrests 61 are also articulated so that they can follow the said adjusting movement. Since these armrests shown in a diagrammatic longitudinal section in FIG. 6 are of identical design for both the left and the right side of the seat furniture, only one armrest will preferably be mentioned below.

In FIG. 6, 41 denotes the upper joint bush already mentioned in the description of FIG. 3 and located at the "rear" end of the armrest. It is mounted on the axle journal 38 shown there. A joint bush 63 of the same basic design fixes the front end of the armrest 61. The joint bush 63 is mounted at the bearing point 62 (FIGS. 1*a* and 5*a*) on a further axle journal not designated, which is connected to the seat frame 4 and has a design similar to that of the axle journal 38. The two joint bushes 41, 63 each carry a leg core 64, 65, for example in the form of a flat iron strip, at the distal end of which there is a leg bend 66, 67 respectively. The leg bends 66, 67, each 1 to 2 cm long, are practically identical and are deflected from a straight line at an angle of 35° to 60° and are placed on top of one another at the armrest bending point 68, so that the underside of the bend 66 of the upper leg core 64 is located opposite the topside of the bend 67 of the lower leg core 65. The two leg cores are, on the one hand, held exactly in alignment with one another by the joint bushes 41, 63 and, on the other hand, are maintained in their relationship relative to one another in a pocket 69 made of a flexible enveloping material, for example a plastic-coated textile.

FIG. 6*a* shows a section along the lines $a_1$—$a_1$ and $a_2$—$a_2$ in FIG. 6, FIG. 6*b* shows the pocket stretched out and empty, and FIG. 6*c* shows the form of the pocket at the bending point 68 on a larger scale.

According to FIG. 6*a*, the leg cores 64, 65 are surrounded by the respective pocket portion 69.1 and 69.2 (FIG. 6*b*) and are embedded in a foam envelope 70. The latter is surrounded by an upholstery covering 71 which extends over the entire armrest and which appropriately leaves the two joint bushes 41, 63 free. FIGS. 6*b* and 6*c* show the design of the pocket 69. Longitudinal seams 72 determine the width and transverse seams 74.1, 74.2 determine the lengths, overlapping one another longitudinally at the center for receiving orifices 73.1, 73.2 (see also FIG. 6*c*) intended for the leg cores 64, 65. It is clearly evident from FIG. 6*c* that at the armrest bending point 68 the upper leg core 64 and the lower leg core 65, or their terminal bends 66, 67, are separated from one another by a duplicate pocket 75 lying between the transverse seams 74.1 and 74.2. The duplicate pocket 75 prevents direct contact between the terminal leg bends 66, 67 (FIG. 6) and is appropriately reinforced in a suitable way.

FIGS. 7, *7a* and *7b* illustrate on a larger scale and in greater detail the supporting foot 1 from FIG. *1a* or a leg 81 of the supporting foot which preferably has five legs. Each of the legs 81 is connected to a central supporting hub 82 intended for receiving the preferably vertically adjustable supporting column 2 already mentioned previously. For this purpose, the supporting foot 1 contains for each leg 81 a spoke designated by 83, which projects radially from the hub 82 and which is connected fixedly to the latter. The spoke 83 is appropriately a rectangular tube and is designed as a basic element, to which a claw member 85 is attached as a radial extension and a carrier of a floor-resting element 84, for example a spherical roller. The spoke 83 also carries the lower part 86 of the supporting-column casing designated by 5 in FIG. 1 and a basic casing 87 connected (in a way not shown) to the casing bottom part 84, in such a way that the two parts 86, 87 are in clamping engagement both with one another and with the spoke 83 and are connected removably to the latter.

The claw member 85 is a shell body with an essentially semicircular shell wall 88, on the inside of which are formed a rib structure 89 for the fastening parts of the floor-resting element (roller) 84 and a plug-in centering device 91. Furthermore, the shell wall 88 carries an assembly pin 92 which passes through a passage orifice 93 on the topside of the spoke 83 and which extends up to its underside 83'. When the claw member 85 is in the assembled state, the plug-in centering device 91 engages into the front end of the spoke cavity 83'', as a result of which a tilt-proof retention of the claw member 85 on the spoke 83 can be achieved. By means of a screw 93 passing through the underside of the spoke 83 and engaging into the assembly pin 92, the spoke and claw member 85 are connected fixedly to one another.

The advantage of such a design of the supporting foot is that supporting feet with legs 81 of different length and intended for floor-resting elements 84 of differing design and be combined in a simple way on a supporting-foot base provided with spokes 83 of uniform length and design. On such floor-resting elements 84, only the parts 91 and 92 necessary for fastening to the spoke 83 need be of the same design, in order to produce economically supporting feet intended for different purposes.

I claim:

1. Seat furniture, comprising: a seat plate (15) and a backrest (14, 16), a seat plate and backrest inclination adjusting mechanism (6) for changing the inclinatonn of the seat plate and backrest in the same direction and independence on one another, the backrest having a bottom part (16) which is pivotably linked to the inclination-adjusting mechanism (6) and a top part (14) which is pivotably linked to the bottom part, the changing of the inclination of the backrest being in the manner of a pendulum movement between a first, at least approximately-vertical limiting position and a second, backwardly-tilted sloping position and fixable by locking the inclination-adjusting mechanism in a desired sloping position of the backrest therebetween, a sliding arrangement (13) connecting the bottom part (16) of the backrest to the seat plate (4), the sliding arrangement comprising a spring-loaded sliding member (20) and a bearing (18) for the pivotable link of the top part (14) of the backrest to the bottom part (16) thereof and spring and stop means (23, 42, 44) also connecting the top part (14) of the backrest to the bottom part (16) thereof for limiting the pivotable motion therebetween between the first, at least approximately-vertical and the second, backwardly-tilted, sloping positions thereof, whereby in its first position the backrest top part (14) loosely rests on the spring-loaded sliding member (20) in a pushed out position, and in its second position it urges the sliding member (20) against the force of the spring and stop means into a pushed in position of the sliding arrangement.

2. Seat furniture according to claim 1, wherein the spring and stop means comprise an elongate leaf spring (23) connected to the bottom part (16) of the backrest, stop means (42, 44) on the top part (14) of the backrest comprising a guide pocket (24) for the leaf spring (23) having a first stop element (45.1) and a second stop element (45.2), and a cam on the leaf spring for movement between the stop elements.

3. Seat furniture according to claim 2, wherein the leaf spring (23) has a pair of bending points (46.1, 46.2) between the bottom part (16) of the backrest and the stop elements (45.1, 45.2) for achieving a springiness effective in the longitudinal direction thereof.

4. Seat furniture according to claim 2, and further comprising an upper armrest leg pivotable about a first bearing point at one end and on the bottom part of the backrest, a lower armrest leg pivotable about a second bearing point at one end and on the seat plate, opposite ends of the upper and lower armrest legs each having a bend and being arranged on top of one another for defining an armrest bending point, and a guide element for so maintaining both opposite ends of the armrest legs.

5. Seat furniture according to claim 3, and further comprising an upper armrest leg pivotable about a first bearing point at one end and on the bottom part of the backrest, a lower armrest leg pivotable about a second bearing point at one end and on the seat plate, opposite ends of the upper and lower armrest legs each having a bend and being arranged on top of one another for defining an armrest bending point, and a guide element for so maintaining both opposite ends of the armrest legs.

6. Seat furniture according to claim 1, and further comprising a headrest (51) pivotably connected to the other end of the top part (14) of the backrest.

7. Seat furniture according to claim 6, and further comprising, for the pivotable connection between the top part (14) of the backrest and the headrest (51), hinges and a leaf spring at a distance behind the hinges.

8. Seat furniture according to claim 7, and further comprising, for displacing the leaf spring longitudinally along the backrest, first and second stop devices, and wherein, in the region of the pivotable connection, the leaf spring is bent for averting the headrest relative to the backrest toward the seat plate.

9. Seat furniture according to claim 1, and further comprising an upper armrest leg pivotable about a first bearing point at one end and on the bottom part of the backrest, a lower armrest leg pivotable about a second bearing point at one end and on the seat plate, opposite, free ends of the upper and lower armrest legs each having a bend and being arranged on top of one another for defining an armrest bending point , and a guide element for so maintaining both the opposite ends of the armrest legs.

10. Seat furniture according to claim 9, wherein the upper and lower armrest legs each have a joint bush at their one ends and a leg core connected to their respective joint bush.

11. Seat furniture according to claim 10, wherein the leg cores each consist of a dimensionally stable material and the guide element is a pocket structure made of a flexible material, the leg cores being guided in the pocket structure at least over some of their extent at a distance from the bends.

12. Seat furniture according to claim 11, wherein, for separating the leg bends from one another, the pocket structure is a double pocket formed at the bending point.

13. Seat furniture according to claim 1, and further comprising a supporting foot comprising a supporting column for supporting the seat plate and backrest at one end and having a central hub at the opposite end, a number of supporting legs arranged about the central hub, spokes between the hub and each of the respective supporting legs, each spoke having a claw member attached to the distal end thereof for receiving a respective one of the supporting legs, and radially inwardly from the claw member being provided with a casing element in clamping engagement with the spoke.

14. Seat furniture according to claim 13, wherein each spoke has, at least in its digital end region, a cavity, each claw member has a shell-type wall partially surrounding the respective spoke end region, and further comprising retaining means for centering and fastening each claw member on the respective spoke which, to engage into the respective cavity, are arranged on the inside of the shell-type wall.

15. Seat furniture according to claim 14, wherein each claw member has a plug-in centering part screwing into the cavity of the respective spoke, and further comprising an assembly pin passing through an orifice into each cavity for securing the screw connection between the respective claw member and spoke.

* * * * *